US008840044B2

(12) United States Patent
Schmitz

(10) Patent No.: US 8,840,044 B2
(45) Date of Patent: Sep. 23, 2014

(54) SPRAY HEAD AND DEVICE FOR THE DISPENSING OF A LIQUID

(75) Inventor: Detlef Schmitz, Lunen (DE)

(73) Assignee: Aptar Dortmund GmbH, Dortmund (DE)

( * ) Notice: Subject to any disclaimer, the term of this patent is extended or adjusted under 35 U.S.C. 154(b) by 549 days.

(21) Appl. No.: 12/989,629

(22) PCT Filed: May 13, 2009

(86) PCT No.: PCT/EP2009/003378

§ 371 (c)(1),
(2), (4) Date: Feb. 1, 2011

(87) PCT Pub. No.: WO2009/138214

PCT Pub. Date: Nov. 19, 2009

(65) Prior Publication Data

US 2011/0114759 A1 May 19, 2011

(30) Foreign Application Priority Data

May 15, 2008 (DE) ..... 20 2008 006 613 U
Jul. 17, 2008 (DE) ..... 20 2008 009 601 U

(51) Int. Cl.

| | |
|---|---|
| ***A62C 31/02*** | (2006.01) |
| ***B05B 1/16*** | (2006.01) |
| ***B65D 83/14*** | (2006.01) |
| *B05B 11/00* | (2006.01) |

(52) U.S. Cl.

CPC ..... *B05B 1/1645* (2013.01); *B05B 1/1672* (2013.01); *B05B 1/169* (2013.01); *B05B 11/0032* (2013.01); *B05B 11/3042* (2013.01); *B65D 83/7532* (2013.01)

USPC ..... 239/393; 239/391; 239/392; 239/397

(58) Field of Classification Search

CPC .. B05B 1/1645; B05B 1/1654; B05B 1/1672; B05B 1/169

USPC ..... 239/302, 327, 589, 322, 321, 331, 349, 239/390, 391, 392, 393, 394, 397, 442, 396

See application file for complete search history.

(56) References Cited

U.S. PATENT DOCUMENTS 3,083,872 A * 4/1963 Meshberg ..... 239/73
3,342,382 A * 9/1967 Huling ..... 222/402.17

(Continued)

FOREIGN PATENT DOCUMENTS

DE 10 2005 037 068 A1 9/2006
DE 10 2005 055 979 A1 10/2006

(Continued)

OTHER PUBLICATIONS

International Search Report prepared by the European Patent Office on Sep. 10, 2009, for International Application No. PCT/EP2009/003378.

(Continued)

*Primary Examiner* — Ryan Reis

(74) *Attorney, Agent, or Firm* — Jason H. Vick; Sheridan Ross, PC

(57) ABSTRACT

Proposed are a spray head with a nozzle for the atomizing of a liquid as well as a device with such a spray head. Associated with the nozzle is a delivery tube that can optionally be folded upward away from the nozzle.

60 Claims, 3 Drawing Sheets

(56) References Cited

U.S. PATENT DOCUMENTS

| | | | | | |
|---|---|---|---|---|---|
| 3,685,181 | A | | 8/1972 | Davidson et al. | |
| 3,703,994 | A | * | 11/1972 | Nigro | 239/397 |
| 3,711,030 | A | * | 1/1973 | Jones | 239/397 |
| 3,913,804 | A | * | 10/1975 | Laauwe | 222/402.11 |
| 4,401,270 | A | | 8/1983 | McKinney | |
| 4,723,725 | A | * | 2/1988 | Comment | 239/533.1 |
| 4,798,311 | A | * | 1/1989 | Workum | 222/131 |
| 4,830,284 | A | * | 5/1989 | Maerte | 239/333 |
| 5,042,697 | A | * | 8/1991 | Warren | 222/402.1 |
| 5,273,191 | A | * | 12/1993 | Meshberg | 222/105 |
| 5,385,303 | A | * | 1/1995 | Gosselin et al. | 239/394 |
| 5,655,691 | A | * | 8/1997 | Stern et al. | 222/402.1 |
| 5,664,732 | A | | 9/1997 | Smolen et al. | |
| 5,826,797 | A | | 10/1998 | Kah | |
| 6,050,505 | A | | 4/2000 | Ou | |
| 6,302,302 | B1 | | 10/2001 | Albisetti | |
| 7,007,867 | B1 | | 3/2006 | Drapeau | |
| 7,278,590 | B1 | | 10/2007 | Greer et al. | |

FOREIGN PATENT DOCUMENTS

| | | | |
|---|---|---|---|
| EP | 0 732 149 | A | 9/1996 |
| WO | WO 83/00640 | A | 3/1983 |

OTHER PUBLICATIONS

International Preliminary Report on Patentability for International (PCT) Patent Application No. PCT/EP2009/003378, mailed Dec. 16, 2010, 8 pages.

* cited by examiner

SPRAY HEAD AND DEVICE FOR THE DISPENSING OF A LIQUID

CROSS REFERENCE TO RELATED APPLICATIONS

This application is a national stage application under 35 U.S.C. 371 of PCT Application No. PCT/EP2009/003378 having an international filing date of 13 May 2009, which designated the United States, which PCT application claimed the benefit of German Application No. 20 2008 006 613.1 filed 15 May 2008 and German Application No. 20 2008 009 601.4 filed 17 Jul. 2008, the entire disclosure of each of which is incorporated herein by reference

SUMMARY OF THE INVENTION

The present invention relates to a spray head for dispensing a liquid and a device as set forth herein.

The term "liquid" is to be particularly understood as including suspensions and fluids as well, optionally with gas phases. For example, it can be cleaning agents or lubricants or other liquids, for example air fresheners, and particularly other technical liquids and fluids as well such as rust removers or the like.

In the present invention, the liquid is preferably delivered as a spray mist or spray stream. However, the liquid can also be delivered in another form, for example as a foam.

A number of spray heads and devices are known in which the spraying characteristics can be adjusted. Up to now, a distinction can be made between two basic types.

In the first type, the rate of output—i.e., the volumetric or mass flow—is varied by means of an upstream, adjustable throttle, as a result of which the spray characteristics can be influenced and adjusted accordingly. A disadvantage here is that the spray characteristics, particularly the spray angle, cannot be adjusted optimally. In the second type, different nozzles are provided which have different spray characteristics and between which output can be switched. A disadvantage here is that the design costs are relatively high and the various nozzles sometimes require considerable size.

It is the object of the present invention to propose a spray head and a device for delivery of a liquid with adjustable or variable spray characteristics that enable a compact, simple and/or cost-effective design and/or simple installation or manufacture.

The above objective is achieved through a spray head or a device as set forth herein. Advantageous modifications are the subject of the subclaims.

A first aspect of the present invention is that the adjustment element has different outlet openings particularly embodied as through holes which can be optionally fluidly connected to the nozzle or to the nozzle opening thereof and/or which differ in particular with respect to their diameter and/or their length. This permits the implementation of very defined and, particularly, different spray characteristics in a simple manner.

A second aspect of the present invention is that the spray head has only one single nozzle or vortex chamber. This permits the implementation of very defined and, particularly, different spray characteristics in a simple manner.

A third aspect of the present invention is that the nozzle has a nozzle opening and/or the adjustment element is arranged downstream from the nozzle, particularly covering the nozzle opening on the outer or output side. This permits the implementation of very defined and, particularly, different spray characteristics in a simple manner.

A fourth aspect of the present invention is that the adjustment element is ring-shaped or cap-like, particularly enclosing the spray head around its periphery. This permits the implementation of very defined and, particularly, different spray characteristics in a simple manner.

A fifth aspect of the present invention is that the adjustment element can be varied, particularly rotated, in a locking manner. This permits the implementation of very defined and, particularly, different spray characteristics in a simple manner.

A sixth aspect of the present invention is that the spray angle of the spray head can be adjusted by means of a adjustment element. This permits the implementation of very defined and, particularly, different spray characteristics in a simple manner.

A seventh aspect of the present invention is that the adjustment element can be or is tensioned against the nozzle—particularly only during delivery or actuation of the spray head. This permits the implementation of very defined and, particularly, different spray characteristics in a simple manner.

An eighth aspect of the present invention is that the adjustment element has an inner surface facing the nozzle with an outlet opening and the nozzle has an outer surface facing the adjustment element with a nozzle opening, with the two surfaces being at least substantially complementary to each other and/or embodied such that the two surfaces lie on top of each other and are pressed together around the outlet or nozzle opening at least substantially in a linear or annular manner at least during delivery of liquid or actuation of the spray head. This permits the implementation of very defined and, particularly, different spray characteristics in a simple manner.

A ninth aspect of the present invention is that the spray head has a sealing means to provide a seal between the nozzle and the adjustment element. This permits the implementation of very defined and, particularly, different spray characteristics in a simple manner.

The aforementioned aspects as well as those additionally described in the following can be implemented individually, which is to say also independently of each other and independently of the features set forth herein, together and/or in any combination, and enable a particularly compact, cost-effective and/or simple design and simple, intuitive operation along with an optimized setting of the spray characteristics and/or in which the construction can be used universally, particularly for different liquids.

BRIEF DESCRIPTION OF THE DRAWINGS

Further advantages, features, characteristics and aspects of the present invention follow from the following description of preferred embodiments on the basis of the drawing.

In the figures, the same reference symbols are used for same or similar parts, with corresponding or comparable characteristics and advantages being achieved even if a repeated description is omitted.

DETAILED DESCRIPTION OF THE INVENTION

Figure 1:
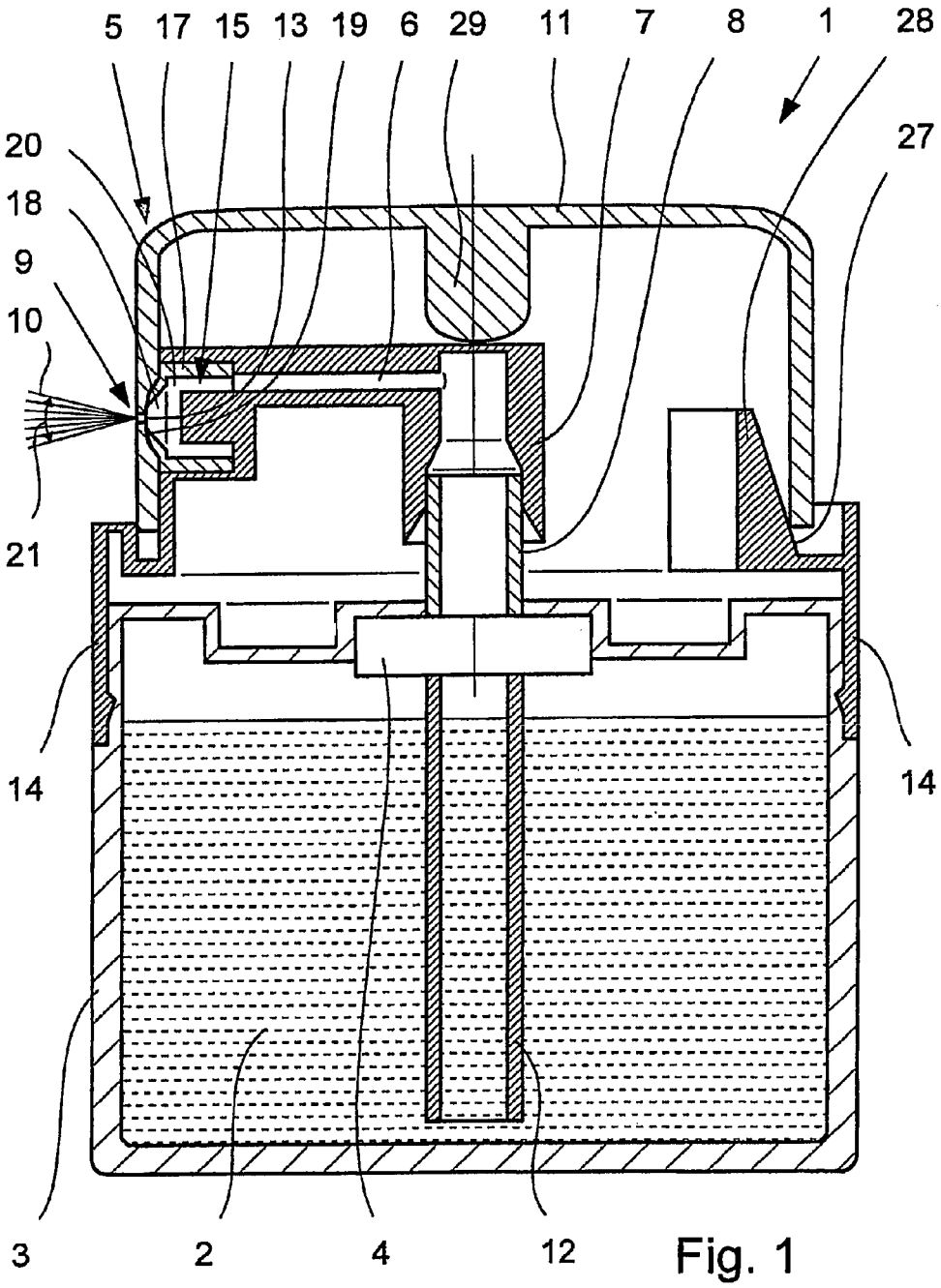
FIG. 1 shows a schematic vertical section of an upper part of a device for delivery of a liquid with a spray head according to a first embodiment.

In a schematic section, FIG. 1 shows a proposed device 1—particularly an aerosol container—for delivery of a liquid 2 in the sense set forth at the outset.

The device 1 has a preferably oblong and/or cylindrical and/or rigid container 3—particularly a metallic can—for the liquid 2 and a valve 4 preferably arranged on the front side of the container 3.

The liquid 2 in the container 3 either can be or is pressurized. In particular, the container 3 or the liquid 2 contains a suitable propellant, preferably a volatile and/or flammable propellant, compressed gas and/or carbon dioxide.

Mounted on the container 3 or valve 4 is a spray head 5 which is particularly mounted after filling of the container 3 with the liquid 2. In the depicted example, the spray head 5 is preferably mounted, placed on or clamped on. However, it can also be attached—detachably as needed—in another appropriate manner.

Alternatively, however, the spray head 5 can also be associated with a dispenser or a pump or the like, particularly connected therewith.

In the depicted example, the spray head 5 has a delivery channel 6 which is or can be fluidly connected to the valve 4 or a valve element 8 of the valve 4 particularly via a connecting piece 7.

The spray head 5 has a nozzle arrangement 9 for delivery of the liquid 2, particularly for the atomization thereof. The nozzle arrangement 9 delivers the liquid 2 for example as a spray mist 10, as suggested in FIG. 1, or as a spray stream.

Upon actuation of the device 1 or of the spray head 5 or of the valve 4—in the depicted example, through depression of the spray head 5 or of an actuation element 11 of the spray head 5 or of the valve element 8—the valve 4 opens. The pressurized liquid 2 can then flow particularly via a riser tube 12 and through the valve 4 and be delivered via the spray head 5, with the liquid 2 flowing via the connecting piece 7 and the delivery channel 6 to the nozzle arrangement 9 and being output there via an outlet opening 13 to the atmosphere in the desired (atomized) form.

In the depicted example, the actuation or opening of the valve 4 preferably occurs through depression of the actuation element 11 and hence of the delivery channel 6 or connecting piece 7 in order to actuate the valve element 8, particularly to depress it and consequently open the valve 4. However, other constructive solutions or actuation mechanisms can be used here as well. This is especially the case if the spray head 5 is used, for example, in a dispenser, a pump or the like.

In the depicted example, the delivery channel is preferably held in a tiltable or pivotable and/or spring-elastic manner on the spray head 5, particularly by a lower part 14 of the spray head 5, and/or is embodied in a single piece therewith. However, other constructive solutions are also possible here. For example, the delivery channel 6 or the connecting piece 7 can also be movable at least substantially linearly in the direction of actuation of the valve 4.

In the depicted example, the spray head 5 or the nozzle arrangement 9 has only one single nozzle 15 and an associated adjustment element 16 to adjust the spray characteristics of the spray head 5 or of the nozzle arrangement 9.

In the depicted example, the nozzle 15 is adjacent to the delivery channel 6. The nozzle 15 is particularly formed by a nozzle element 17 built into the delivery channel 6 or adjacent thereto. The nozzle element 17 is preferably manufactured separately and then inserted into a corresponding receiving chamber or the delivery channel 6. However, other constructive solutions are also possible here.

The nozzle 15 or the nozzle element 17 thereof forms a nozzle chamber 18 and has a nozzle opening 19 on its output side. In particular, the nozzle chamber 18 tapers toward the nozzle opening 19, preferably in a conical manner.

Preferably, the nozzle chamber 18 forms a vortex chamber of the nozzle 15 or of the spray head 5. Targeted vortex formation can be achieved through appropriate inflow channels 20 particularly flowing with a tangential component into the nozzle chamber 18 which also extend particularly in a radial manner toward the nozzle opening 19 and are only suggested in FIG. 1.

The adjustment element 16 is adjacent on the output side to the nozzle 15 or nozzle opening 19 and/or covers them.

The outlet opening 13 downstream from the nozzle opening 19 is formed in the adjustment element 16. To adjust the spray characteristics, the adjustment element 16 has several outlet openings 13 in the depicted example with different spray characteristics. The outlet openings 13 differ particularly with respect to their diameter and/or their length. The outlet openings 13 are particularly embodied as through holes and/or are cylindrical. However, other constructive solutions are also possible here.

The outlet openings 13 can optionally be arranged in front of the nozzle opening 19. For this purpose, the adjustment element 16 is accordingly variable, particularly rotatable, relative to the nozzle 15 or the nozzle opening 19 thereof. Inversely, however, the nozzle 15 can also be moveable, particularly rotatable, in order to optionally arrange one of the outlet openings 13 in front of the nozzle opening 19.

The outlet opening 13 has a considerable influence on the spray characteristics of the spray head 5 or nozzle arrangement 9. Particularly, a spray angle 21 of the spray mist 10 or of a spray stream can be varied or adjusted through the selection of the corresponding outlet opening 13—i.e., through the rotational position of the adjustment element 16.

Preferably, the nozzle arrangement 9 is separated into the (stationary and/or common) nozzle 15 containing or forming the vortex chamber and into the downstream outlet opening 13 that can be changed or selected (switched or moved) to adjust the spray characteristics. Particularly, the outlet opening 13 or the adjustment element 16 can also be understood as a variable or changeable screen for setting the respectively desired spray characteristics of the spray head 5 or of the nozzle arrangement 9.

Preferably, the spray head 5 or the nozzle arrangement 9 has only one single nozzle 15 and/or vortex chamber.

Preferably, the nozzle opening 19 is covered by the adjustment element 16 on the outside or on the dispensing side.

Preferably, the adjustment element 16 is ring-shaped and/or cap-like. Particularly, the adjustment element 16 encloses the spray head 5 in a peripheral manner.

The adjustment element 16 is preferably rotatable. By turning or depending on the position of the adjustment element 16, one of the outlet openings 13 can optionally be fluidly connected to the nozzle 15 or the nozzle opening 19 thereof.

Figure 2:
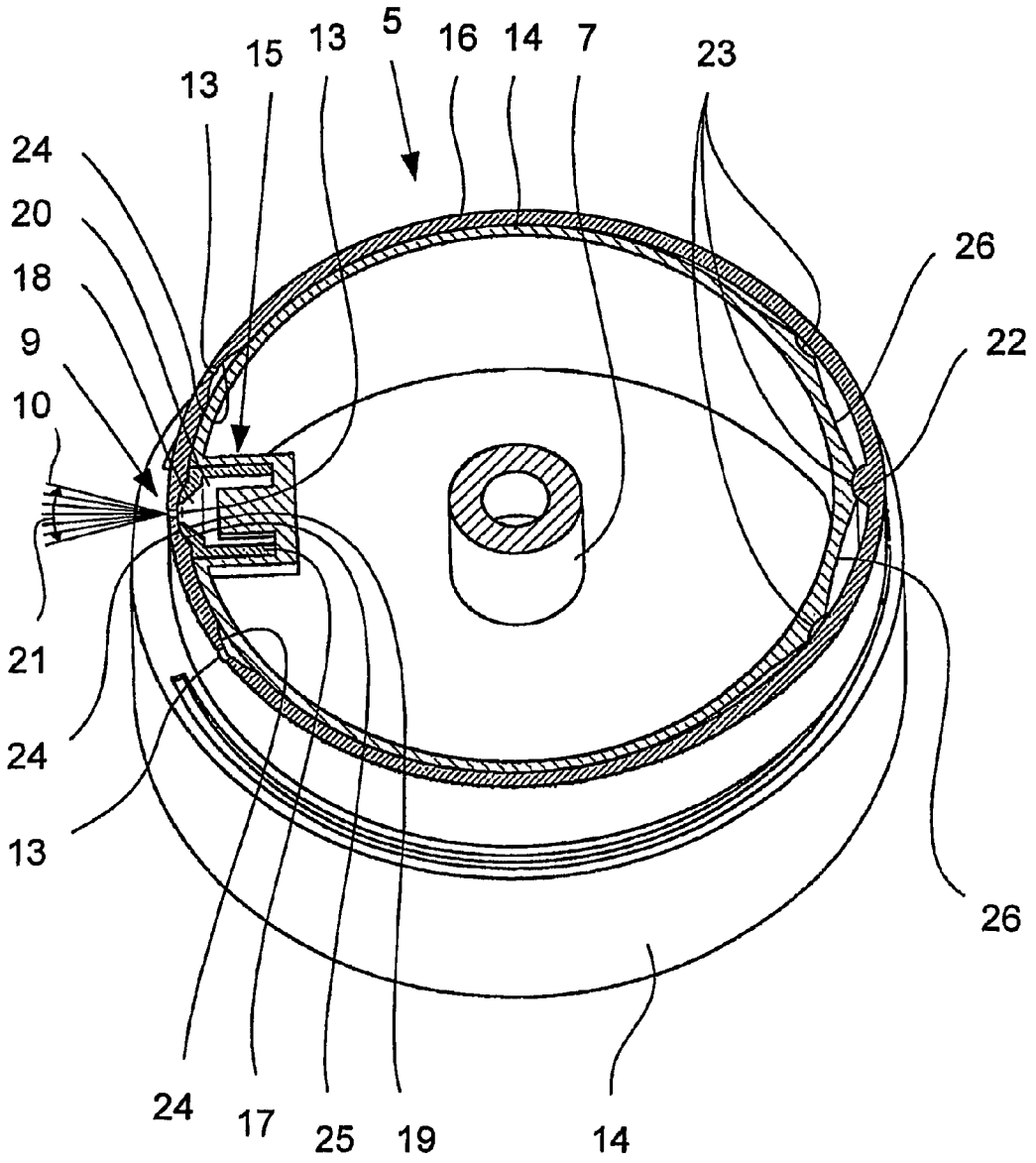
FIG. 2 shows a schematic horizontal section of the spray head.

It follows from the schematic horizontal section of the spray head 5 according to FIG. 2 that the outlet openings 13 are preferably arranged at the spray head 5 or adjustment element 16 and spaced in the peripheral direction. Depending on the rotational position of the adjustment element 16, an outlet opening 13 is then located in front of the nozzle 15 or nozzle opening 19. Optionally, the nozzle 15 or nozzle opening 19 can also be completely sealable by the adjustment element 16.

The adjustment element 16 is preferably variable in a locking manner. For this purpose, the spray head 5 preferably has a corresponding locking mechanism. In the depicted example, the locking mechanism can have, for example, a projection 22 which is particularly formed on the inside of the adjustment element 16 and protrudes radially inward. By engaging in an associated recess 23, for example on a supporting surface that guides the adjustment element 16 on the inside and is particularly formed by the lower part 14, a suitable locking mechanism can be fashioned. However, the locking mechanism can also serve another purpose as explained below or be formed in another manner.

The spray head 5 preferably has a sealing means to form a seal between an inner surface 24 of the adjustment element 16 facing the nozzle 15 and an outer surface 25 of the nozzle 15 or of the nozzle element 17 facing the adjustment element 16. In particular, the inner surface 24 is formed by the flat area of the adjustment element 16 enclosing an outlet opening 13. In particular, the outer surface 25 is formed by the flat area enclosing the nozzle opening 19.

According to a preferred modification, the sealing means or seal is particularly fashioned such that the inner surface 24 is concave, spherical, recessed and/or conical in the area of the outlet opening(s) 13 and the outer surface 25 is embodied to be at least substantially complementary thereto or vice versa. Alternatively or in addition, the aforementioned locking means or locking effect can also be achieved in this manner.

Especially preferably, the spray head 5 is or the inner surface 24 and the outer surface 25 are embodied such that the two surfaces lie on top of each other around the outlet opening 13 or nozzle opening 19 at least substantially (only) in a linear or annular manner. This is conducive to a good seal.

According to an additional or alternative modification, the spray head 5 preferably has a tensioning means in order to pretension the adjustment element 16 against the nozzle 15 or the inner surface 24 against the outer surface 25 or vice versa. This can be achieved, for example, through appropriate shaping and/or dimensioning of the adjustment element 16 relative to the lower part 14, to the nozzle 15 and/or to other components of the spray head 5 and/or of the inner surface 24 to the outer surface 25. In particular, an elastic deformation or deformability of parts, projections or the like can be considered or exploited here.

Particularly, the adjustment element 16 is manufactured from a more flexible and/or softer material than the lower part 14 or other components of the spray head 5 in order to exploit a defined elastic deformation, for example upon switching from one outlet opening 13 to another outlet opening 13, to engage in the respective position and/or to achieve a desired seal.

According to an especially preferred modification, the pretensioning is achieved or the pretensioning means are fashioned by tensioning the adjustment element 16 radially outward on the side opposite the nozzle 15 (this can be achieved particularly by at least one projection 22 which is guided outward for example on a slide surface or thickening 26 running tangentially, for instance) in order to tension the adjustment element 16 peripherally or over its circumference and thus press with its inner surface 24 against the nozzle 15, particularly in order to achieve or improve the seal between nozzle 15 and adjustment element 16 or between nozzle opening 19 and outlet opening 13. In particular, it is thus possible for the projection 22 at least substantially opposite the nozzle 15 to be forced radially outward on the slide surface 26 upon turning the adjustment element 16, as a result of which the adjustment element 16 is tensioned in the area of the nozzle 15 with correspondingly greater force against the nozzle 15. Only when the final rotational position of the adjustment element 16 is reached (in this final position, the desired outlet opening 13 is in front of the nozzle 15 or the nozzle opening 19 thereof) is the cited projection 22 able to engage in the optionally provided recess 23 in the slide surface 26, hence enabling the desired locking effect or locking mechanism.

In addition or alternatively, further possibilities for pretensioning or for fashioning the pretensioning means are available which are explained below.

According to an additional or alternative aspect of the present invention, the spray head 5 can have an inclined plane 27 to achieve the pretensioning or to fashion the pretensioning means in order to achieve a radial tensioning of the adjustment element 16 against the nozzle 15 upon actuation of the spray head 5, here depression of the actuation element 11 or adjustment element 16. In the example shown in FIG. 1, the inclined plane 27 is formed by one or more preferably rigid ribs 28. The ribs 28 are preferably molded on the lower part 14 or on another component of the spray head 5.

The inclined plane 27 is preferably arranged on the side opposite the nozzle 15 or nozzle arrangement 9 and/or embodied such that, upon depression of the adjustment element 16, the adjustment element 16 is moved radially outward by sliding on the inclined plane 27 and thus tensioned against the nozzle 15.

However, other constructive solutions are also possible here which are explained in the following on the basis of FIG. 3, which shows a second embodiment of the proposed spray head 5 in a schematic vertical section. In the following, only substantial differences with respect to the first embodiment are explained, so the previous remarks apply particularly in a supplementary manner or as appropriate.

In the first embodiment, the adjustment element 16 is preferably cap-like or embodied as a covering of the spray head 5. The adjustment element 16 is preferably connected or provided with the actuation element 11 in the first embodiment. In the first embodiment, shown in FIG. 1, an actuating projection 29 is preferably adjacent to the actuation element 11 which presses on the delivery channel 6 or the connecting piece 7 upon actuation, which is to say it transfers the movement of the depression.

Figure 3:
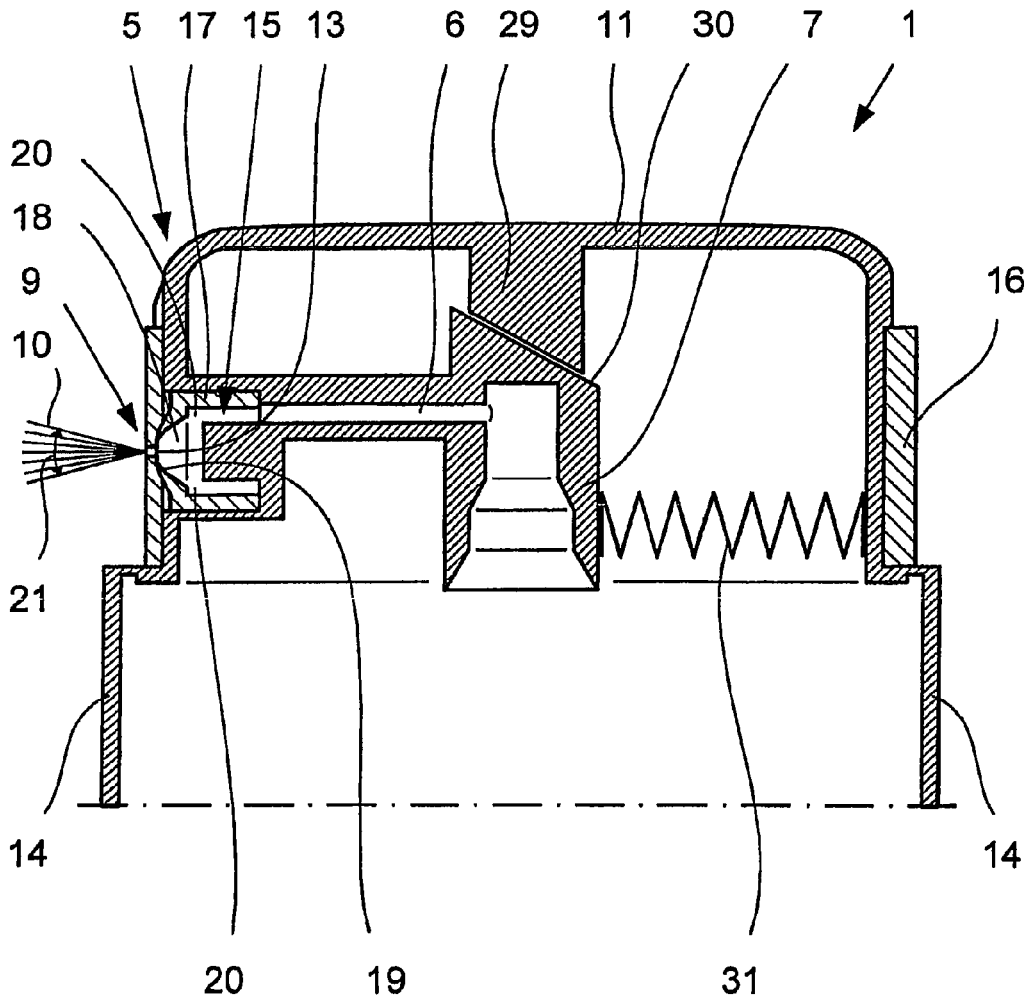
FIG. 3 shows a schematic vertical section of a spray head according to a second embodiment.

In the second embodiment, shown in FIG. 3, the actuation element 11 is formed separately from the adjustment element 11, for example by a lower part 4 or another part. Alternatively or in addition, the actuating projection 29 is provided with the inclined plane 27 which particularly cooperates with a complementarily inclined slide-off surface 30 on the delivery channel 6 or connecting piece 7 such that, upon actuation or depression of the spray head 5, of the actuation element 11 or actuating projection 29, the inclined plane tends to slide along the slide-off surface 30 such that the delivery channel 6 is tensioned radially outward in the direction of the nozzle 15 and thus together with the nozzle 15 against the adjustment element 16 in the area of the inner surface 24—i.e., against the outlet opening 13 thereof. In this case, the nozzle 15 is tensioned counter to the adjustment element 16. In this way as well, the desired seal between nozzle 15 and adjustment element 16 can again be achieved or at least improved.

In the possible ways of achieving pretensioning or fashioning a pretensioning means, the pretensioning preferably occurs only during the delivery of the liquid 2 or actuation of the spray head 5. However, it is also possible in principle to pretension the adjustment element 16 against the nozzle 15 or the nozzle opening 19 thereof or vice versa not only during the actuation of the spray head 5 or the delivery of liquid 2 but also beyond that. This can, as already explained, be achieved through appropriate shaping of the inner surface 24 and outer surface 25 and/or general pretensioning of the adjustment element 16 against the nozzle 15. Alternatively or in addition, the pretensioning means can also have a spring 31 or be formed by it, as indicated in FIG. 3.

The spring 31 preferably tensions the delivery channel 6 with the nozzle 15 or optionally only the nozzle 15 against the adjustment element 16. For this purpose, the spring 31 preferably engages on the connecting piece 7 on the side facing away from the nozzle 15. At the other end, the spring 31 is supported, for example, on a stationary part of the spray head 5, such as the lower part 14, or on the adjustment element 16, for example, or another covering cap or another actuation element of the spray head 5. However, other constructive solutions are also possible here.

The spring 31 is preferably made of plastic.

The spring 31 is preferably embodied as a coil spring. However, it can also be a leaf spring or other spring.

In general, it should be noted that the actuation element 11 can also be embodied independently from the adjustment element 16, particularly as a separate piece.

Preferably, the outlet openings 13 are smaller in diameter than the nozzle opening 19 in the depicted examples. However, it is also possible in principle for only one outlet opening 13 to be smaller in cross section than the nozzle opening 19. For example, if only two outlet openings 13 are provided, the other outlet opening 13 can also have the same diameter as the nozzle opening 15 if necessary or even have a larger diameter.

In general, it is also possible for one, several or all outlet openings 13 to have the same diameter as the nozzle opening 19. The desired influencing of the spray characteristics then occurs particularly as a result of the length of the respective outlet opening 19, particularly as a result of different radial thicknesses of the adjustment element 16 in the area of the respective outlet opening 19. To vary the length of the respective outlet opening 13 (more precisely, these are then outlet channels, even though only outlet openings are generally spoken of in the present specification; the term "outlet opening" is therefore to be understood in this more general sense), the adjustment element 16 can also be appropriately thickened only in the area of the respective outlet opening 13 as needed. However, other constructive solutions are also possible here.

Preferably, the spray head 5 is embodied such that at least two spray characteristics, particularly two spray angles 21, can be set by means of the adjustment element 16. Accordingly, the adjustment element 16 or the spray head 5 preferably has at least two or only two different outlet openings 13 which can be used for the delivery of the liquid or can be placed in front of the nozzle 15.

The spray direction of the spray head 5 preferably runs at least substantially horizontally and/or crossways to the direction of actuation or direction of depression.

The spray direction of the spray head 5 preferably runs at least substantially radially to the ring-shaped extension of the adjustment element 16 and/or at least substantially on the ring plane of the adjustment element 16.

In the described embodiments, the adjustment element 16 has various outlet openings 13 which lead, accordingly, to different spray characteristics. In principle, however, it is also possible to arrange a variable outlet opening 13 in front of the nozzle opening 19—i.e., on the delivery side again, as in the other sample embodiments. For example, a corresponding change of the spray characteristics can then be achieved by changing the diameter of the outlet opening 13 in the manner of a screen.

In general, the spray head 5 is preferably made of plastic and/or as an injection-molded part. In particular, the lower part 14, the delivery channel 6 and the connecting piece 7 are preferably embodied as a single piece. The adjustment element 16 is also preferably embodied as a single piece and/or mounted or snapped onto the spray head 5 or the lower part 14 thereof. However, other constructive solutions are also possible here.

The invention claimed is:

1. Spray head for delivering a liquid, consisting of
a single nozzle, and comprising:
a variable adjustment element for adjusting spray characteristics of the spray head, and
an actuation element for triggering product delivery,
wherein
the adjustment element has different outlet openings which can be selectively connected to the nozzle or a nozzle opening thereof,
wherein the spray head further comprises a pretensioning device to apply a radial tensioning of the adjustment element against the nozzle by depression of the actuation element.

2. Spray head as set forth in claim 1, wherein the nozzle or an outer surface thereof is pressed against the adjustment element or an inner surface thereof upon actuation of the spray head.

3. Spray head as set forth in claim 1, wherein the adjustment element or an inner surface thereof is pressed against the nozzle or an outer surface thereof upon one or more of actuation of the spray head and when a position is reached in which an outlet opening of the adjustment element lies over the nozzle opening of the nozzle or when a locking position of the adjustment element is reached.

4. Spray head as set forth in claim 1, the spray angle of the spray head can be adjusted by means of the adjustment element.

5. Spray head as set forth in claim 1, wherein the nozzle has the nozzle opening upstream from the adjustment element or a changeable outlet opening.

6. Spray head as set forth in claim 1, wherein the adjustment element is one or more of ring-shaped and cap-like, and encloses the spray head in a peripheral manner.

7. Spray head as set forth in claim 1, wherein the adjustment element is adjustable, and rotatable, in a locking manner.

8. Spray head as set forth in claim 1, wherein the adjustment element has an inner surface facing the nozzle with an outlet opening and the nozzle has an outer surface facing the adjustment element with a nozzle opening, with the two surfaces being one or more of at least substantially complementary to each other and embodied such that the two surfaces lie on top of each other one or more of around the outlet and nozzle opening at least substantially in a linear or annular manner at least during delivery of liquid or actuation of the spray head.

9. Spray head as set forth in claim 1, wherein the spray head has a sealing means to provide a seal between the nozzle and the adjustment element.

10. Spray head as set forth in claim 1, wherein an inner surface is one or more of concave, semispherical, recessed and conical in the area of an outlet opening.

11. Spray head as set forth in claim 1, wherein an outer surface is one or more of convex, semispherical, projecting and conical in the area of a nozzle opening.

12. Spray head as set forth in claim 1, wherein the adjustment element or the outlet opening thereof ultimately sets the spray characteristics or influences them decisively.

13. Spray head as set forth in claim 1, wherein the adjustment element or an outlet opening thereof forms the outlet of the spray head.

14. Spray head as set forth in claim 1, wherein the adjustment element has or forms a flat actuation element for an actuation, and depression, of the spray head.

15. Spray head as set forth in claim 1, wherein the spray direction of the spray head runs one or more of at least substantially radially to a ring-shaped extension of the adjustment element and at least substantially on a ring plane of the adjustment element.

16. Device for delivering a liquid, comprising a container containing the liquid and a spray head which is associated with a valve of the container, with the spray head having a nozzle for atomizing the liquid, wherein the spray head has a variable adjustment element for adjusting spray characteristics of the spray head, wherein the adjustment element has different outlet openings which can selectively be fluidically connected to the same nozzle which differ with respect to at least one of their diameter and their length, and wherein the spray head comprises a pretensioning device that applies a radial tensioning of the adjustment element against the nozzle by selection of a respective outlet opening.

17. Device as set forth in claim 16, wherein the container, and the liquid, is one or more of pressurized, contains a propellant, a volatile propellant, a flammable propellant, compressed gas and carbon dioxide.

18. Spray head as set forth in claim 1, wherein the different outlet openings differ only with respect to one or more of their diameter and their length.

19. Spray head as set forth in claim 1, wherein the outlet openings are embodied as through holes.

20. Spray head as set forth in claim 1, wherein the spray head has only one single vortex chamber.

21. Spray head as set forth in claim 1, wherein the container, and the liquid, is one or more of pressurized, contains a propellant, a volatile propellant, a flammable propellant, compressed gas and carbon dioxide.

22. Spray head for delivering a liquid comprising:

a nozzle, and a variable adjustment element for adjusting spray characteristics of the spray head, wherein the adjustment element has different outlet openings for adjusting spray characteristics which outlet openings can be selectively connected to the nozzle or a nozzle opening thereof, and wherein the outlet openings are moveable selectively in front of the nozzle on its outlet side and open directly into the environment, wherein the adjustment element has an inner surface facing the nozzle and the nozzle has an outer surface facing the adjustment element, and wherein the inner surface has recesses in the area of each of the outlet openings into which a projection of the nozzle is selectively extendable, wherein the projection is: formed on the outer surface, arranged in an area of the nozzle, and is generally pointed, conical or complementary to the recesses in shape.

23. Spray head as set forth in claim 22, the spray angle of the spray head can be adjusted by means of the adjustment element.

24. Spray head as set forth in claim 22, wherein the spray head has one or more of: only one single nozzle and a single vortex chamber.

25. Spray head as set forth in claim 22, wherein the nozzle has the nozzle opening which is upstream from the adjustment element or a changeable outlet opening.

26. Spray head as set forth in claim 22, wherein the adjustment element is one or more of ring-shaped and cap-like, and encloses the spray head in a peripheral manner.

27. Spray head as set forth in claim 22, wherein the adjustment element is adjustable, and rotatable, in a locking manner.

28. Spray head as set forth in claim 22, wherein the adjustment element or the outlet opening thereof ultimately sets the spray characteristics or influences them decisively.

29. Spray head as set forth in claim 22, wherein the adjustment element or the outlet opening thereof forms the outlet of the spray head.

30. Spray head as set forth in claim 22, wherein the different outlet openings differ only with respect to one or more of their diameter and their length.

31. Spray head as set forth in claim 22, wherein the outlet openings are embodied as through holes.

32. Spray head as set forth in claim 22, wherein the spray head has only one single nozzle.

33. Spray head for delivering a liquid comprising:

a nozzle, and a variable adjustment element for adjusting spray characteristics of the spray head, wherein the adjustment element has different outlet openings which can be selectively connected to the nozzle or the nozzle opening thereof, wherein the spray head is made of plastic, wherein the adjustment element is made of at least one of a softer and more elastic material than a lower part of the spray head holding or forming the nozzle, wherein the adjustment element is tensioned against the nozzle via elastic deformation of the adjustment element, wherein the adjustment element is rotatable relative to the nozzle, wherein the outlet openings of the adjustment element can be selectively connected to the nozzle or nozzle opening thereof, and wherein the spray head comprises a locking mechanism, said locking mechanism holds the nozzle or nozzle opening with the connected outlet opening in a selected position.

34. Spray head as set forth in claim 33, wherein the nozzle or the outer surface thereof is pressed against the adjustment element or the inner surface thereof upon actuation of the spray head.

35. Spray head as set forth in claim 33, wherein the adjustment element has an inner surface facing the nozzle with an outlet opening and the nozzle has an outer surface facing the adjustment element with a nozzle opening, with the two surfaces being one or more of at least substantially complementary to each other and embodied such that the two surfaces lie on top of each other one or more of around the outlet and nozzle opening at least substantially in a linear or annular manner at least during delivery of liquid or actuation of the spray head.

36. Spray head as set forth in claim 33, wherein the spray head has a sealing means to provide a seal between the nozzle and the adjustment element.

37. Spray head as set forth in claim 33, wherein the inner surface is one or more of concave, semispherical, recessed and conical in the area of an outlet opening.

38. Spray head as set forth in claim 33, wherein the outer surface is one or more of convex, semispherical, projecting and conical in the area of a nozzle opening.

39. Device as set forth in claim 16, the spray angle of the spray head can be adjusted by means of the adjustment element.

40. Device as set forth in claim 16, wherein the spray head has one or more of only one single nozzle and only a single vortex chamber.

41. Device as set forth in claim 16, wherein the nozzle has a nozzle opening which is upstream from the adjustment element or a changeable outlet opening.

42. Device as set forth in claim 16, wherein the adjustment element is one or more of ring-shaped and cap-like, and encloses the spray head in a peripheral manner.

43. Device as set forth in claim 16, wherein the adjustment element is adjustable, and rotatable, in a locking manner.

44. Device as set forth in claim 16, wherein the adjustment element or the outlet opening thereof ultimately sets the spray characteristics or influences them decisively.

45. Device as set forth in claim 16, wherein the adjustment element or the outlet opening thereof forms the outlet of the spray head.

46. Device as set forth in claim 16, wherein the container containing the liquid in pressurized form.

47. Spray head as set forth in claim 1, wherein the pretensioning device comprises an inclined plane to achieve the pretensioning.

48. Spray head as set forth in claim 1, wherein the pretensioning device comprises a spring.

49. Spray head as set forth in claim 1, wherein the pretensioning device is arranged on a side opposite to the nozzle or nozzle arrangement such that upon depression of the adjustment element said element is moved radially outward by sliding on the inclined plane and thus tensioned against the nozzle.

50. Spray head as set forth in claim 1, wherein the inclined plane is formed by or comprises one or more rigid ribs.

51. Spray head as set forth in claim 50, wherein the ribs are arranged on a lower part or on another component of the spray head.

52. Spray head as set forth in claim 1, wherein the pretensioning device is adapted to tension of the adjustment element against the nozzle for forming a seal between the nozzle and adjustment element.

53. Device as set forth in claim 16, wherein the pretensioning device comprises a projection arranged opposite the nozzle.

54. Device as set forth in claim 16, wherein the pretensioning device comprises an inclined plane to achieve the pretensioning.

55. Device as set forth in claim 16, wherein the pretensioning device comprises a spring.

56. Device as set forth in claim 16, wherein the pretensioning device is adapted to tension the adjustment element against the nozzle for forming a seal between the nozzle and adjustment element.

57. Spray head as set forth in claim 33, wherein the locking mechanism comprises a projection formed on the inside of the adjustment element.

58. Spray head as set forth in claim 33, wherein the projection protrudes radially inwards and engages in an associated recess.

59. Spray head as set forth in claim 58, wherein the recess is arranged on a supporting surface that guides the adjustment element on the inside.

60. Spray head as set forth in claim 58, wherein the recess is formed by a lower part.

* * * * *